United States Patent [19]

Burke et al.

[11] Patent Number: 4,993,142

[45] Date of Patent: Feb. 19, 1991

[54] METHOD OF MAKING A THERMISTOR

[75] Inventors: Francis M. Burke; William L. Buchanan, both of El Paso, Tex.

[73] Assignee: Dale Electronics, Inc., Columbus, Nebr.

[21] Appl. No.: 368,281

[22] Filed: Jun. 19, 1989

[51] Int. Cl.[5] ..... H01C 17/28

[52] U.S. Cl. ..... 29/621; 29/411; 29/412; 29/527.6; 29/611; 338/22 R

[58] Field of Search ..... 29/33 M, 411, 412, 414, 29/415, 417, 527.2, 527.6, 611, 613, 620, 593, 616, 621; 338/22 R, 22 SD, 203; 427/126.2, 126.4, 126.5, 284, 289, 290, 431, 423, 427

[56] References Cited

U.S. PATENT DOCUMENTS

| | | | |
|---|---|---|---|
| 4,434,416 | 2/1984 | Schonberger | 29/414 X |
| 4,480,376 | 11/1984 | Hakanson | 29/593 |
| 4,531,110 | 7/1985 | Johnson, Jr. et al. | 338/22 R |
| 4,766,409 | 8/1988 | Mandai | 338/22 R |
| 4,786,888 | 11/1988 | Yoneda et al. | 338/22 R |

*Primary Examiner*—Joseph M. Gorski
*Assistant Examiner*—Peter Dungba Vo
*Attorney, Agent, or Firm*—Zarley, McKee, Thomte, Voorhees & Sease

[57] ABSTRACT

A method of making a thermistor comprising the steps of making a layer of thermistor ceramic material comprised substantially of $Mn_2O_3$, NiO, $Co_3O_4$, $Al_2O_3$, CuO, or $Fe_2O_3$, having upper and lower surfaces. A first dielectric material comprised of low K $Al_2O_3$ or the like is placed on the upper and lower surfaces of the layer, and then is cut into a plurality of elongated strips. The layer is created by blading a slurrey of the ceramic material to create a plurality of uncured sheets; placing the sheets in superimposed position, and then making the monolithic layers from the sheets by applying heat and pressure thereto, and then firing the monolithic layer with heat of increased magnitude. The strips are encapsulated in an envelope of the dielectric material, and terminal connections comprised of silver, Ni, Sn and Pb are imposed thereon. A thermistor chip or strip comprising an elongated ceramic thermistor body with an outside surface and opposite ends. A dielectric envelope encapsulates the outer surface of the body for the ends, and conductive terminal caps are formed on the end of the body. The thermistor is comprised of the materials outlined in the method of making the same.

3 Claims, 2 Drawing Sheets

METHOD OF MAKING A THERMISTOR

BACKGROUND OF THE INVENTION

The present invention relates to a negative temperature coefficient (i.e. "N.T.C.") thermistor for use in temperature measurement, control, and compensation of electronic elements or circuits.

A typical N.T.C. thermistor is shown in U.S. Pat. No. 4,786,888. This patent discloses a thermistor element produced through sintering ceramic in the form of a chip. It is sandwiched by a pair of electrodes and enclosed in an envelope made of glass. In this regard, the device only operates to secure or stabilize the thermal or chemical properties of the thermistor element when the thermistor is used for measuring temperature.

A thermistor of the above type has many drawbacks requiring relatively complex production processes, low production capacities, poor yields, and unnecessary diffusive boundary layers. In addition, such thermistor elements require leads which require connections to external devices. This makes difficult the assembly of the thermistor element onto a circuit board.

A less difficult way to build a surface mounted thermistor element which would secure the thermal, chemical and solderability properties would be enveloping the thermistor element in a low K dielectric material. This low K dielectric material, which is low fire and acid resistant, would accept silver electrodes that are compatible with nickel, and Sn/Pb plating. This eliminates the need for complex production processes, poor yields, and unnecessary diffusive boundary layers.

Therefore, a principal object of this invention is to provide a surface mount thermistor element that would maintain thermal, chemical, and solderability properties, and which is more reliable.

A further object of this invention is to provide a method of making a thermistor which is economical and efficient, and which will not be detrimental to the resulting product.

A further object of the present invention is to provide a negative temperature coefficient ceramic material that can be plated with nickel and tin (Sn)/lead (Pb) plating for surface mount applications.

A still further object of this invention is to provide a negative temperature coefficient thermistor with production processing steps which has an envelope of low K insulating dielectric for enclosing the thermistor for surface mount applications.

A still further object of the present invention is to provide a thermistor of the above type suitable for soldering directly onto a printed circuit board for surface mount applications.

A still further object of the present invention is to provide a thermistor which is stable in operation at higher operating temperatures for surface mount applications.

A still further object of the present invention is to provide a method of producing thermistors in high volumes and with excellent yields.

These and other objects will be apparent to those skilled in the art.

SUMMARY OF THE INVENTION

The N.T.C. thermistor of this invention comprises: (1) a sintered thermistor ceramic chip, (2) an insulating low K dielectric for enclosing the thermistor chip to be coupled after sintering to the ceramic chip, (3) and a pair of external electrodes, silver plateable, on the exterior surface of the ceramic chip and the insulating low K dielectric. Specifically, the insulating ceramic envelope is made of an oxide or different variety of oxide ceramic materials. Furthermore, the external electrodes are made out of plateable silver.

In a preferred form, a sintered ceramic wafer has a low K $Al_2O_3$ or ceramic oxide loaded (sprayable rheology) sprayed onto the top and bottom surfaces of the wafer. The material is dried and fired in a continuous furnace. Specifically, the material dried in an infrared or convection oven and sintered in an infrared or convection furnace. Atmospheric conditions during firing are in either an oxidizing or neutral atmosphere.

Once the low K dielectric has been vitrified onto the N.T.C. ceramic wafer, the wafer is cut into strips or chips. The strips and chips are either sprayed or dipped in a sprayable or dippable rheology to encapsulate the remaining uncovered areas of the strips or chips. The strips or chips are fired in a continuous infrared or convection kiln. Strips are cut into individual ceramic chips.

The above devices in chip form, are dipped in a dippable silver rheology to encapsulate the N.T.C. thermistor chip surfaces which are not encapsulated with a low K dielectric.

The above devices in a negative temperature coefficient thermistor chip form, are then provided with terminals by being plated with a nickel (Ni) barrier, followed by a tin (Sn)/lead (Pb) plating onto the surface of the nickel. The parts with silver termination are dried in an infrared or convection oven and are fired in a continuous infrared or convection furnace. The silver termination provides a conductive path through the thermistor ceramic chip. The external termination and plating on the thermistor chip will allow the thermistor chip to be mounted directly onto a printed circuit board.

The essence of this invention is to provide a nickel barrier over silver using conventional plating techniques without adversely affecting the thermistor ceramic material and its inherent electrical properties.

BRIEF DESCRIPTION OF THE DRAWINGS

FIG. 7 is an enlarged scale sectional view taken on line 7—7 of FIG. 6; and FIG. 8 is an elongated sectional view taken on line 8—8 of FIG. 6.

DETAILED DESCRIPTION OF THE PREFERRED EMBODIMENT

Figure 1:
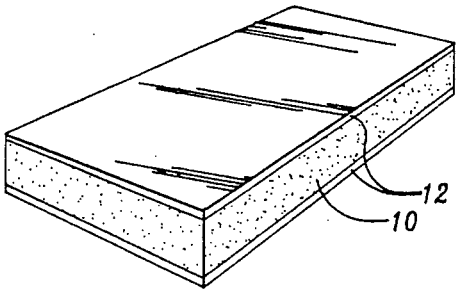
FIG. 1 is a perspective view of a ceramic wafer with an insulating dielectric material on the top and bottom surfaces thereof.

FIG. 1 shows a ceramic wafer or layer 10 with dielectric layers 12 affixed to the upper and lower surfaces thereof. The wafer 10 is a negative temperature coefficient ceramic material made from materials such as $Mn_2O_3$, NiO, $Co_3O_4$, $Al_2O_3$, CuO, and $Fe_2O_3$. The dielectric layers 12 are comprised of a material such as a low K $Al_2O_3$ or ceramic oxide loaded dielectric. A low K $Al_2O_3$ or ceramic oxide loaded dielectric is used because they are acid resistant which protects the thermistor wafer 10 from acid during the plating process.

The layer 10 is created by adding $Mn_2O_3$, NiO, $Co_3O_4$, $Al_2O_3$, CuO, or $Fe_2O_3$ to a slurry of organic binder, plasticizer, lubricant, solvent and dispersant. Uncured sheets of this material each having a thickness of 100 μm are prepared by the conventional doctor blade method. The uncured sheets are stacked together and are made into monolithic form by applying pressures thereto between 3,000–30,000 p.s.i., and under temperatures between 30°–70° C., for a period between 1 second to 9 minutes. The resulting monolithic form, layer 10, is then fired at a rate between 10°–60° C./hr to a temperature of 1000° C.–1300° C. for about 1 hour to 42 hours and controlled cool down rate of 20°–100° C./hr to become a sintered negative coefficient thermistor. With this process, the layer 10 comprises a monolithic sintered thermistor body.

Figure 2:
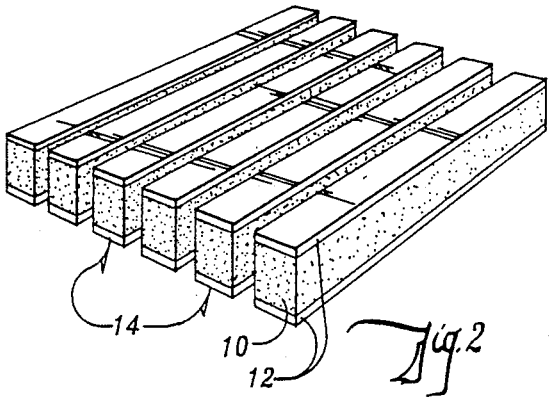
FIG. 2 is a perspective view of the ceramic wafer of FIG. 1 after it has been cut into a plurality of elongated strips.
Figure 3:
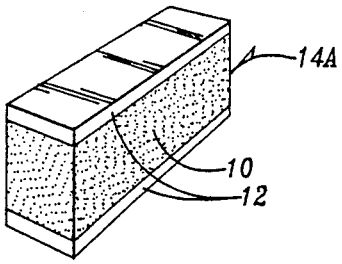
FIG. 3 is an enlarged scale perspective view of a thermistor ceramic chip material with an insulating dielectric material on the top and bottom surface created by cutting one of the strips of FIG. 2 into shorter increments.

After the layer 10 is so created, the dielectric layers 12 are applied to the top and bottom surfaces thereof with sprayable rheology. Layers 12 comprised of low K $Al_2O_3$ or ceramic oxide loaded dielectric are then dried in an infrared or convection oven at a temperature of 75° C.–200° C. for 5 minutes to 1 hour. They are then fired in an infrared or convection furnace to a temperature of 700° C.–900° C. for 5 minutes to 1 hour. The resulting device of FIG. 1 can then be cut into individual strips 14 or into chips 14A (see FIGS. 2 and 3).

The uncoated sides of the strips 14 or chips 14A can then be sprayed or dipped with the same material comprising layers 12 to create dielectric layer 16. After this has been done, the strips 14 or chips 14A units are then dried in an infrared or convection oven to a temperature of 75° C.–200° C. for 5 minutes to 1 hour, and then fired in an infrared or convection furnace to a temperature of 700° C.–950° C. for 5 minutes to 1 hour. This procedure produces for strips 14 and chips 14A a vitrified dielectric envelope 18 of low K $Al_2O_3$ or ceramic loaded dielectric on four sides of the thermistor body. Chips 14A can be cut from the elongated strips 14.

Terminal caps 20 are then created on the ends of the strips 14 or the chips 14A. The ends are first dipped in plateable silver termination material 22 so that the ends of the wafer layer 10 are in direct contact therewith. The silver termination material 22 has an undried band width of 45 μm to 800 μm and are prepared by the doctor blade method. After the silver termination 22 has been so applied, the strips 14 or the chips 14A are dried in an infrared or convection oven at a temperature of 100°–300° C. for 5–35 minutes. They are then fired in an infrared or convection furnace at a temperature of 500°–700° C. for 5 to 25 minutes.

The silver termination material 22 is then plated with a barrier layer 24 comprised of Ni having a thickness of 100–500 μ inches. Layers 25A and 25B are then imposed on the layer 24 by plating. Layer 25A is comprised of Sn and layer 25B is copprised of Pb. Layers 25A and 25B have a total thickness of 100–500 μ inches.

Figure 4:
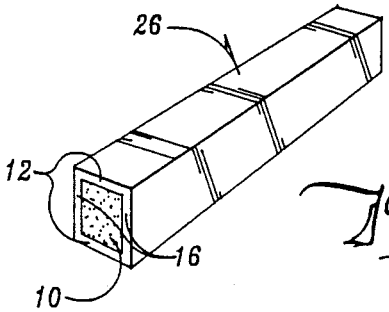
FIG. 4 is a perspective view of one of the strips of FIG. 2 encapsulated within an insulating dielectric material.
Figure 5:
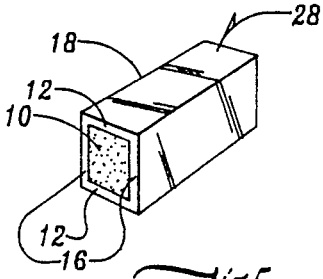
FIG. 5 is a perspective view of a sintered thermistor chip encapsulated with an insulating dielectric material and created by cutting the strip of FIG. 4 into shorter increments.

The strip 14 shown in FIG. 4 completely encapsulated in envelope 18 is identified by the numeral 26. The completed chip 14A completely encapsulated in envelope 18, as shown in FIG. 5, is identified by the numeral 28. The terminal caps described heretofore can be applied to either the strips 26 or the chips 28.

Figure 6:
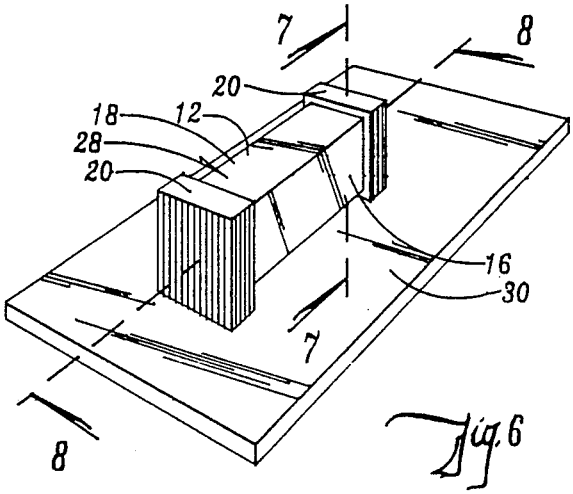
FIG. 6 is a perspective view of the chip of FIG. 5 with end caps thereon and mounted on a circuit board.

The completed strips 26 or chips 28 can be directly soldered to the circuit board 30 as shown in FIG. 6.

By using the above mentioned materials and processes, a thermistor is created which has a smaller variance in resistance and has ideal soldering characteristics for mounting on printed circuit boards. This invention enables the production of thermistors having good quality, stability, and a higher yield rate.

It is therefore seen that the device and method of this invention achieve all of their stated objectives.

What is claimed is:

1. A method of making a thermistor, comprising:

making a layer of thermistor ceramic material having upper and lower surfaces;

placing a first dielectric material on said upper and lower surfaces of said layer, cutting said layer into a plurality of elongated strips with dielectric material on the upper and lower surfaces, and with sides and ends thereof being exposed, placing a second dielectric material on said exposed sides of said strips, wherein said first and second dielectric materials form an insulating and chemical resisting envelope over said upper and lower surfaces and sides of each said strip; and placing conductive terminals over the ends of said strips by placing on the ends thereof successive layers of silver, Ni, Sn, and Pb with portions of the terminals extending over the envelope.

2. A method of making a thermistor, comprising:

making a layer having upper and lower surfaces from a slurry material comprised substantially from one of $Mn_2O_3$,NiO, $Co_3O_4$, $Al_2O_3$, CuO, and $Fe_2O_3$;

placing a first dielectric material on said upper and lower surfaces of said layer, cutting said layer into a plurality of elongated strips with dielectric material on the upper and lower surfaces, and with sides and ends thereof being exposed, placing a second dielectric material on said exposed sides of said strips, wherein said first and second dielectric materials form an insulating and chemical resisting envelope over said upper and lower surfaces and sides of each said strip; and placing conductive terminals over the ends of said strips by placing on the ends thereof successive layers of silver, Ni, Sn, and Pb with portions of the terminals extending over the envelope.

3. The method of claims 1 or 2 including after placing each of said layer of silver, subjecting said strip to heat in the range of 100°–300° C. for 5–35 minutes, and then firing at a temperature of 500°–700° C. for 5–25 minutes.

* * * * *